US005470211A

United States Patent [19]

Knott et al.

[11] Patent Number: 5,470,211

[45] Date of Patent: Nov. 28, 1995

[54] ROLLER PUMP

[75] Inventors: Erwin Knott, Poing; Andreas Hahn, Sauerlach, both of Germany

[73] Assignee: Stöckert Instrumente GmbH, Munich, Germany

[21] Appl. No.: 289,009

[22] Filed: Aug. 11, 1994

[30] Foreign Application Priority Data

Aug. 12, 1993 [DE] Germany ..... 43 27 152.9

[51] Int. Cl.[6] ..... F04B 43/08

[52] U.S. Cl. ..... 417/477.9; 417/477.11

[58] Field of Search ..... 417/477.1, 477.3, 417/477.7, 477.8, 477.9, 477.11, 476, 474

[56] References Cited

U.S. PATENT DOCUMENTS

| | | | |
|---|---|---|---|
| 315,667 | 4/1885 | Serdinko | 417/477.8 |
| 2,909,125 | 10/1959 | Daniels | 417/477.9 |
| 2,965,041 | 12/1960 | Clark | 417/477.9 |
| 3,137,242 | 6/1964 | Hahn | 417/477.7 |
| 3,366,071 | 1/1968 | Dutler | 417/477.9 |
| 3,787,148 | 1/1974 | Kopf | 417/477.9 |
| 4,138,205 | 2/1979 | Wallach | 417/477.11 |
| 4,189,286 | 2/1980 | Murry et al. | 417/477.11 |
| 4,363,609 | 12/1982 | Cosentino et al. | 417/477.9 |
| 4,432,707 | 2/1984 | Anderson et al. | 417/477.7 |
| 4,519,754 | 5/1985 | Minick | 417/477.11 |
| 4,545,744 | 10/1985 | Weber et al. | 417/477.9 |
| 4,548,553 | 10/1985 | Ferster | 417/477.7 |
| 4,564,342 | 1/1986 | Weber et al. | 417/477.9 |
| 4,568,255 | 2/1986 | Lavender | 417/477.9 |
| 4,976,590 | 12/1990 | Baldwin | 417/477.3 |
| 5,230,614 | 7/1993 | Zanger et al. | 417/477.9 |

FOREIGN PATENT DOCUMENTS

| | | |
|---|---|---|
| 0518290 | 12/1992 | European Pat. Off. . |
| 1553005 | 9/1969 | Germany . |
| 3726452 | 2/1989 | Germany . |
| 3326786 | 11/1989 | Germany . |
| 4135609 | 5/1993 | Germany . |
| 2144805 | 11/1994 | United Kingdom . |
| 8203426 | 10/1982 | WIPO . |

*Primary Examiner*—Richard A. Bertsch
*Assistant Examiner*—Peter G. Korytnyk
*Attorney, Agent, or Firm*—Scully, Scott, Murphy & Presser

[57] ABSTRACT

A roller pump for medical technology, in particular for pumping blood in extracorporeal circulations. The roller pump has a stator (1) with a cylindrical hollow space (2), the wall structure of which is formed as a support wall (3) for a pump tube (5) led along this wall about the central longitudinal axis of the hollow space. A pump rotor is rotatably arranged about its central longitudinal axis (4) in the pump stator, the rotor having rollers (8) which are rotatably supported on roller supports (7) and roll along the tube upon rotation of the rotor and compress the tube. The support wall (3) of the pump stator has an opening (6) with an inlet region (10) and an outlet region (12) for the tube (5) and, in these regions, this support wall deviates from the circular path of motion of the pump rollers (8) at a differing curvature along the direction as this path of motion. The support wall (3) has a continuously increasing radius of curvature in the inlet region (10) in the direction of motion of the pump rollers (8) and a continuously decreasing radius of curvature in the outlet region (12) in the direction of motion of the rollers.

6 Claims, 3 Drawing Sheets

ROLLER PUMP

BACKGROUND OF THE INVENTION

1. Field of the Invention

Figure 1:
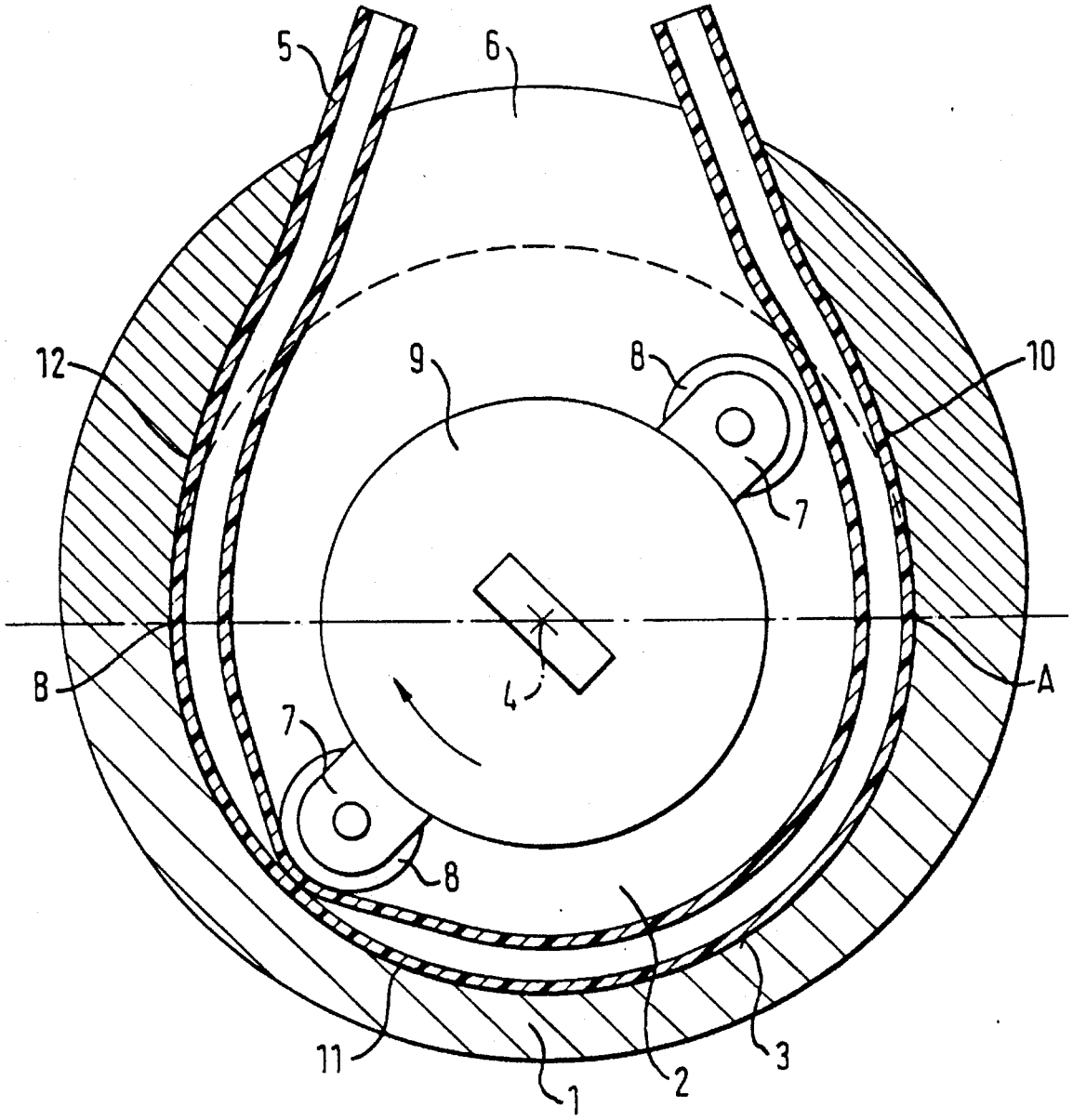

The invention relates to a roller pump for medical technology, in particular for conveying blood in extracorporeal circulations. This roller pump has a stator with a cylindrical hollow space, the wall structure of which, commonly designated as the pump bed in the field of this technology, is formed as a support wall for a pump tube led along this wall about the central longitudinal axis of the hollow space. A pump rotor in the pump stator is rotateable about its central longitudinal axis, the rotor having rollers rotatably supported on roller supports, the rollers rolling along the tube and compressing this upon rotation of the rotor. The support wall of the pump rotor has an opening with an inlet and an outlet region for the tube and in which regions this support wall received from the circular path of motion of the pump rollers with a curvature in the same direction as this path of motion.

2. Discussion of the Prior Art

A roller pump of this kind is known from DE-B-33 26 786. As a rule, such a roller pump has two rollers which are diametrically opposed with reference to the rotational axis of the rotor. The pump rollers push the pump tube together to such an extent along a larger portion of the circumference of the support wall that the interior of the pump tube is occluded in a liquid-tight manner at this location. On account of the rolling along of the pump rollers when the stator turns, the occlusions of the tube travel with the rollers, the liquid in the tube in front of the occlusions being further transported in the rotational direction of the stator. The tube recedes from the roller path in the region of the inlet and outlet opening, on account of which the rollers increasingly lift away from the tube in the outlet region of the pump stator arranged in front of this opening in the rotor direction, while they increasingly press into the tube in the inlet region which follows in the rotational direction. On account of the provision of at least two pump rollers, at least one roller presses against the pump tube for each position of the roller so that a further transport of the pumping medium is guaranteed.

During pivoting of the pumping rollers towards and away from the tube, the momentary pumping stream of the pump varies. Thus, the momentary pumping stream of the pump reduces to the extent of the tube volume which is generated in the tube during the pivoting away of the rollers on account of the ensuing removal of the tube occlusion. In unfavorable cases, a deflection of the flow direction can occur at the outlet cross-section of the tube, this being accompanied by large forces which result on account of the mass moment of inertia of the pumping medium and lead to the danger of considerable blood damage. The minimalization of this pressure pulsation conditional upon this principle is a considerable prerequisite for the use of roller pumps for pumping blood, as it can lead to a large damage rate (haemolysis) of cells on account of the high proportion of sensitive cell components in the blood.

In the previously known roller pumps, the roller supports are pressed strongly in a radial direction outwardly against the tube, whereas the inventive support wall of the pump bed has a curvature in the same direction as the circular path of the rollers in the outlet region, the curvature having a continuously increasing radius of curvature in the rotational direction of the rollers. This is to ensure substantial independence from the cross-section of the pump tube used as well as an occlusion of the pump tube with a defined spring force in the case of varying operational conditions while pressure pulsations in the pumping medium are substantially reduced. On account of this shape of the curvature path in the outlet region of the support wall, the pivoting of the roller away from the pump tube is extended over a larger rotational angle. On account of this, the pumping medium within the pumping tube on the pressure side has the possibility to slowly and continuously compensate the volume increase occurring on account of the pivoting of the pump rollers away from the tube and the removal of the occlusion, on account of which a reduced pulsation behavior ensues.

However, it has been discovered that it is essential for preventing damage of the cell components in blood that the occurring unavoidable reduction in the pump throughflow during pivoting of the pump rollers away from the tube has gradients which are as flat as possible in order to minimise the mass moment of an inertia and the pressure pulsation resulting from this, in particular the negative delayed pressure peaks.

SUMMARY OF THE INVENTION

It is therefore the object of the invention to provide a roller pump with an optimum pumping behavior with respect to the prevention of possible blood damage in which the compensation of the tube volume captured by the roller ensues over the longest possible time period or through the largest possible rotational angle of the roller support and in which the unavoidable reduction of the pump throughflow has flat gradients. This is achieved according to claim 1 in the roller pump of the previously mentioned type in that the support wall of the stator in the inlet region of the pump tube and the pumping medium has a continuously increasing radius of curvature in the direction of motion of the pump rollers and a continuously decreasing radius of curvature in the outlet region in the direction of motion of the rollers, these radii of curvature being larger than the radius of curvature in the region between the inlet and outlet region. A discontinuous jump in the radius of curvature at the transition between the working region and the inlet and outlet regions of the support wall of the stator can be provided, and in fact from a smaller radius of the working region to a substantially larger radius of the inlet and outlet regions. The center of circle of the radii of curvature can lie on one curve bending from a plane extending through the center axis of the hollow space of the stator and the starting line of the outlet opening and, respectively, the end line of the inlet opening. In this case, it is useful that the distance of the axes of the pump rollers from the rotational axis of the pump rotor is constant.

It can also be useful to be able to adapt the path of curvature in the inlet and outlet regions of the support wall to a predetermined path of curvature by changing or adjusting the support wall in these regions. This can be realized in that the support wall has one or more radially moveable and/or adjustable segments in the inlet and outlet regions. On account of this adjustability, an adaptation of the path of curvature to various tube diameters and tube geometries can be achieved. Additionally, within limits, a certain pressure profile can be generated. The angular velocity of the roller supports bearing the rollers can be adjusted or controlled in dependence upon the roller position with reference to the path of curvature of the inlet and outlet regions. The measured pressure progression can also be included in this control.

On account of the extension in the inventive roller pump* of the pivoting of the pump rollers away from the pump tube in the outlet region and of the pivoting of the rollers back towards the pump tube in the inlet region over a large rotational angle range, good protection of the tube and, thus, an extension of its service life is achieved. The tube protection can also be improved further in that all the pump rollers of the pump stator are actuatable with respect to one another by means of an actuating connection so that also those pump rollers in the region of the inlet and outlet opening of the pump stator at a distance from the tube do not lose their rotational velocity, but with a maintained rotational velocity are again pivoted against the pump tube in the inlet region of the support wall after passing the inlet and outlet opening. On account of this, an acceleration of the pump rollers from approximately zero to its full rotational speed when rolling along the tube no longer occurs in this roller position so that no frictional wear is produced on the outer wall of the pump tube.

Figure 2:
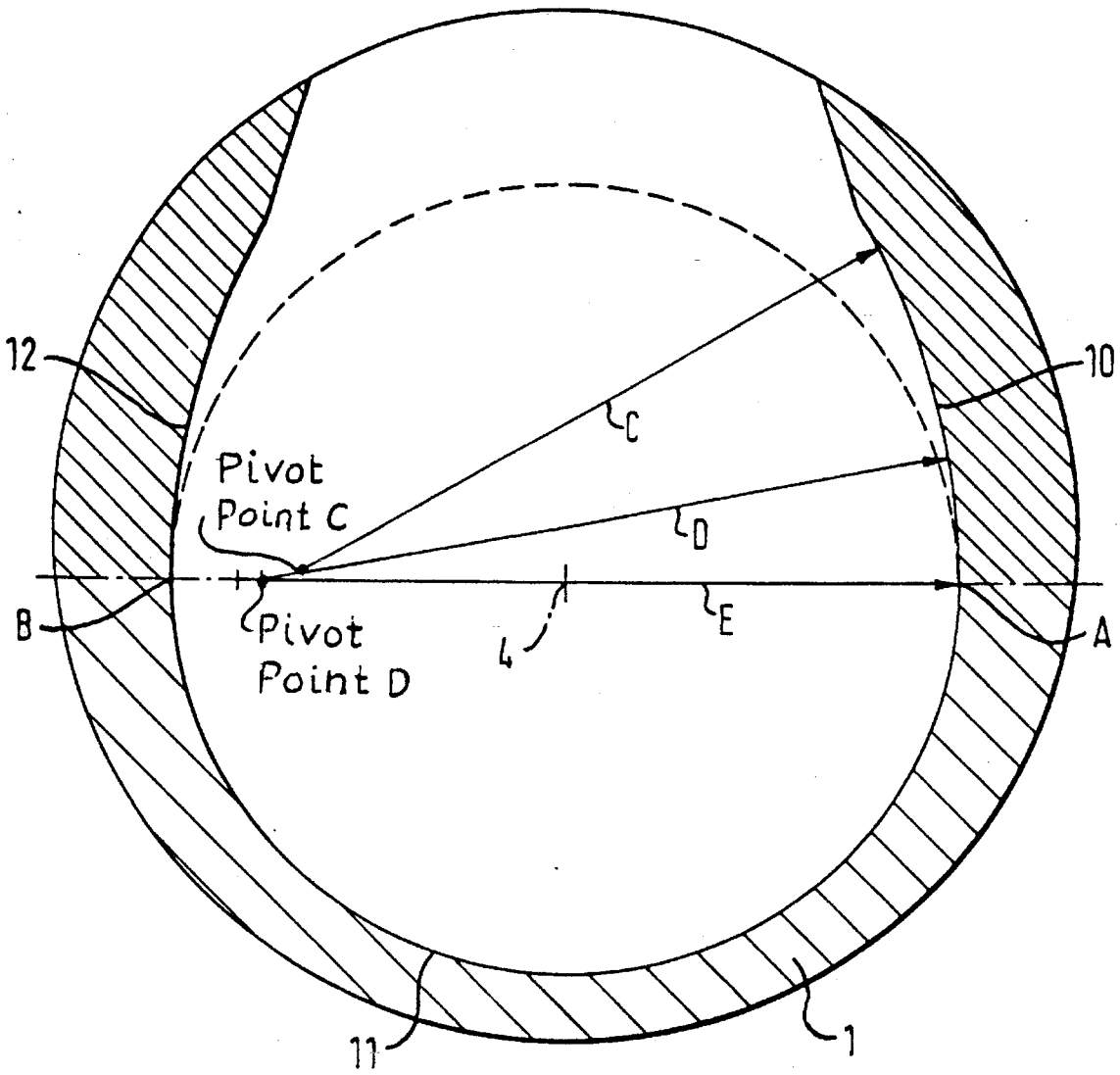
Figure 3:
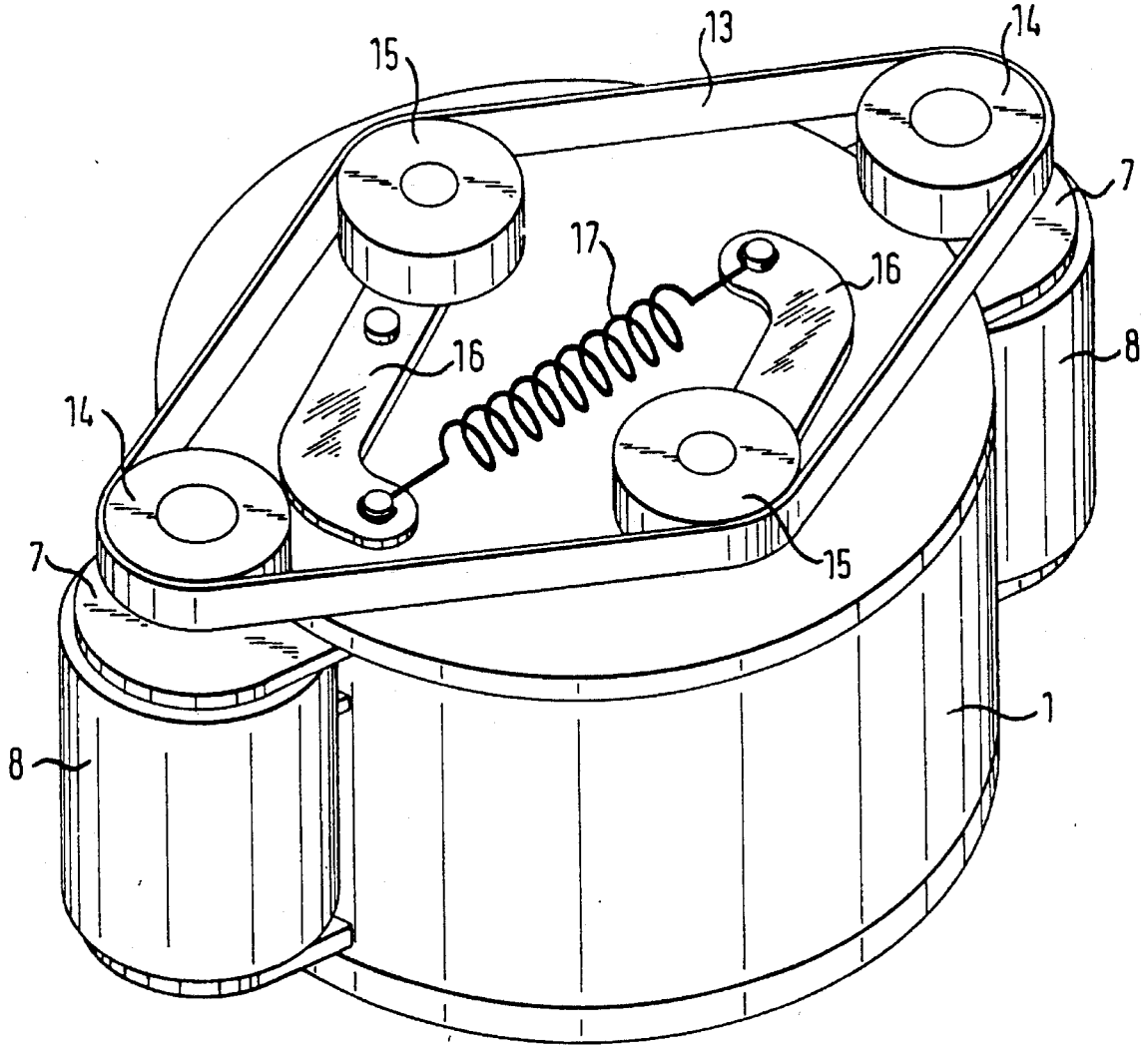

An embodiment of the inventive roller pump described in more detail in the following is shown in the drawings, in which:

FIG. 1 schematically shows this embodiment of the inventive roller pump in cross-section through the pump stator, FIG. 2 shows in the same form of illustration the path of curvature of the inlet and outlet regions of the support wall of the pump stator on the basis of radii of curvature, and FIG. 3 shows a further embodiment of the inventive roller pump in a slanted view.

The stator denoted with 1 in FIG. 1 has a cylindrical hollow space 2, the walling of which serves as a support wall 3 for a pump tube 5 led along this wall around the central longitudinal axis 4 of the hollow space. At a peripheral location of the support wall 3, there is an opening 6 in the stator through which the tube 5 enters and exits the stator. A pump rotor 9 is arranged in this pump stator to be rotatable about the central longitudinal axis 4 and has roller supports 7 projecting radially from it, rollers 8 being rotatably supported thereon at their ends. These rollers are arranged in such a manner on the roller supports that they are pushed against the tube 5 in a rotational angular region of the pump rotor of approximately 180° so that they completely occlude this at certain locations and no liquid can flow through the tube where it is occluded. Upon continuous rotation of the rotor 9, the roller pressed against the tube pushes the occlusion along in front of itself, on account of which the liquid quantity in front of the occlusion point is transported forward in the tube. The roller supports can be radially displaceable slides which are radially outwardly spring-loaded.

The curvature of the support wall 3 at the center of circle 4 has an inlet region 10 which extends from the inlet and outlet opening 6 for the tube 5 into the stator up to a point A at which the pump rollers completely occlude the tube 5. This is the location in the embodiment shown in FIG. 1 which is located approximately 90° behind the center of the inlet and outlet opening. A working or full pumping region 11 adjoins this inlet region 10 and extends from the aforementioned angular position through 180° to a point B which is located approximately 90° ahead of the center of the inlet and outlet opening 6. The outlet region 12 begins at this point and extends up to the inlet and outlet opening 6. From this point onwards, the pump rollers 8 increasingly lift away from the pump tube 5 upon further rotation so that the occlusion of the tube is gradually removed until the pump rollers are pivoted completely away from the pump tube and moved towards the inlet region 10.

As is apparent from FIG. 1, in the case of full occlusion of the pump tube 5 by one of the two pump rollers 8, this pump is not only closed in cross-section but its interior also experiences an additional volume reduction on account of the contact of the pump roller 8 along a part of its periphery. When this pump roller 8 is swung away from the pump tube in the outlet region 12 of the support wall, a volume increase in the pump tube ensues, on account of which the momentary pumping stream of the pump is reduced. On account of the simultaneous back flow of the pumping medium in the pump in front of the pump roller into the tube volume freed by the roller, a certain change in the flow direction occurs in this tube section which is accompanied by large forces resulting from the mass moment of inertia of the pumping medium.

In order to distribute the compensation for the volume taken up by the roller by means of the tube occlusion over the longest time period and through the largest rotational angle of the rotor possible, the support wall at the inlet region 10 and at the outlet region 12 recedes from the circular path of motion of the pump rollers 8 in the direction towards the inlet and outlet opening 9 with a curvature in the same direction as the path of motion of the rollers. The support wall at the inlet region 10 has a continuously increasing radius of curvature in the direction of motion of the pump rollers 8 and in the outlet region 12 a radius of curvature which continuously decreases in the direction of motion of the rollers, these radii of curvature being substantially larger than the radius of curvature in the working or full pumping region 11 so that a discontinuous jump of the radius of curvature occurs respectively between the working region and the inlet and outlet regions. It is shown in FIG. 2 how the center points of the radii of curvature are displaced in the inlet region 10 of the support wall from a radius of curvature C located at the start of the inlet region 10 in the direction of rotation of the roller to a radius of curvature E located at the end of the inlet region.

On account of the afore-mentioned inventive progression of curvature in the inlet and outlet regions 10, 12, a flat gradient of the change of the pump flow fin the tube is achieved, on account of which a minimalization of the mass moment of inertia and the resulting pressure pulsation, in particular of the negative delayed pressure peaks, is achieved.

On account of the pivoting of the pump rollers against the tube and the subsequent rolling of the rollers along the tube, a compression and squeezing of the tube is brought about and the squeezing travels along the tube until it is removed by the pivoting away of the rollers. This material loading of the tube can lead over time to damage of the tube. The more abrupt the pivoting of the rollers towards and away from the tube, the greater the damage. On account of the inventive progression of the curvature at the inlet and outlet regions, this pivoting towards and away from the tube takes place over a longer period of time and through a larger angle of rotation of the rotor, on account of which the tube loading is reduced.

Upon pivoting of the pump rollers towards the tube, a further tube loading occurs in roller pumps of the type known up to now in that during this process, the pump roller is accelerated from a zero rotational velocity at the roller support to the maximum roller velocity which corresponds to the speed at which the rollers roll along the tube. In the embodiment of the inventive roller pump shown in FIG. 3, this tube loading is avoided in that the rollers of the rotor are actuatable with respect to one another by means of a drive connection so that the pump roller pivoting against the tube is maintained by the diametrically opposite pump roller simultaneously pivoting away from the tube at the rotational velocity the pivoting away pump roller had while rolling along the tube. This drive connection is formed by a continuous belt 13 which passes over the drive rollers 14 arranged on the axes of the pump rollers 8 and over tension rollers 15. The tension rollers 15 sit on pivoting levers 16 and are pressed outwardly on these against the belt 13 by a tension spring 17 connecting the levers. However, the pivoting lever 16 can also be respectively acted upon by a tension or compression spring.

We claim:

1. Roller pump for medical technology, in particular for pumping blood in extracorporeal circulations, the roller pump having a stator with a cylindrical hollow space, the stator including a wall which is formed as a support wall for a pump tube laid along said wall about the central longitudinal axis of the hollow space, rollers rotatably supported on roller supports, the rollers being rollable in a circular path of motion along the tube and pressing said tube together upon rotation of the rotor, the support wall of the pump rotor having an opening defining an inlet region and an outlet region for the tube and in which regions said support wall deviates from the circular path of motion of the pump rollers at a differing curvature along the direction of said circular path of motion, wherein the support wall (3) in the inlet region (10) has a continuously increasing radius of curvature in the direction of motion of the pump rollers (8) and in the outlet region (12) has a continuously decreasing radius of curvature in the direction of motion of the rollers, said radii of curvature (C, D, E) being larger than the radius of curvature in the area of the opening between the inlet and outlet regions.

2. Roller pump according to claim 1, wherein the center point of the radii of curvature in the inlet and outlet regions (10, 12) of the support wall (3) lie on a curve which bends from a plane extending through the central axis of the hollow space parallel to the plane of the inlet and outlet opening (6) of the pump stator (1) towards said inlet and outlet opening.

3. Roller pump according to claim 1, wherein the radii of curvature of the support wall in the area of the opening between the inlet region (10) and the outlet region (12) are adjustable.

4. Roller pump according to claim 3, wherein the support wall (3) in the area of the opening between the inlet region and the outlet region (10, 12) is respectively formed by a plurality of wall segments which are radially moveable for adjusting the radii of curvature of the support wall.

5. Roller pump according to claim 1, wherein the roller supports (7) rotatably supporting the pump rollers (8) possesses an angular velocity of motion which is variable in dependence upon the roller position along the periphery of the stator cavity support wall.

6. Roller pump according to claim 1, wherein a drive interconnects the pump rollers (8) for conjointly operating with each other.

* * * * *